US005832866A

United States Patent [19]

Stoudt

[11] Patent Number: 5,832,866

[45] Date of Patent: Nov. 10, 1998

[54] SIGN SUPPORT WITH CAPTIVE FLAGS

[76] Inventor: Theodore L. Stoudt, 16 Southwest Cellini Ct., Lake Oswego, Oreg. 97035

[21] Appl. No.: 878,519

[22] Filed: Jun. 19, 1997

Related U.S. Application Data

[63] Continuation of Ser. No. 353,800, Dec. 12, 1994, abandoned.

[51] Int. Cl.[6] ..... G09F 17/00

[52] U.S. Cl. ..... 116/173; 116/63 R; 116/63 P

[58] Field of Search ..... 116/63 P, 173, 116/174, 175, 303, 309, 313, 63 R; 40/610, 612; 248/538

[56] References Cited

U.S. PATENT DOCUMENTS

| | | | |
|---|---|---|---|
| 3,616,557 | 11/1971 | Vara, Sr. | 40/610 X |
| 3,786,778 | 1/1974 | Palmer et al. | 116/313 |
| 4,619,220 | 10/1986 | Seely et al. | 116/63 P |
| 4,980,984 | 1/1991 | Kulp et al. | 40/610 |
| 5,152,091 | 10/1992 | Leach | 40/610 X |
| 5,197,408 | 3/1993 | Stoudt | 116/173 |
| 5,507,245 | 4/1996 | Kennedy | 116/28 R |

FOREIGN PATENT DOCUMENTS

| | | | |
|---|---|---|---|
| 514527 | 2/1955 | Italy | 116/63 R |

*Primary Examiner*—Thomas B. Will
*Assistant Examiner*—Willie Morris Worth

[57] ABSTRACT

A signing system in the form of a support staff, a flexible sign and a plurality of flag poles. One end of the respective poles being pivotally secured to the staff and an elongate, resilient foldable retaining member connected to the flag poles intermediate the ends thereof. Securing and positioning devices are provided for positioning the flag poles, wherein the flag poles can be moved from a storage position adjacent the staff to a display position only by stretching the retaining member.

9 Claims, 1 Drawing Sheet

SIGN SUPPORT WITH CAPTIVE FLAGS

CROSS-REFERENCE TO RELATED APPLICATION

This is a continuation of application Ser. No. 08/353,800, filed Dec. 12, 1994, now to be abandoned, to which priority is claimed.

FIELD OF THE INVENTION

This invention relates to display devices generally and more particularly to outdoor signs such as highway and roadside signs. The invention may be used indoors as well but typically is used in association with highway repair or construction or out of doors merchandising such as, for example, automobile sales, etc.

BACKGROUND OF THE INVENTION

Portable sign stands provide a very important safety function along streets and highways where construction or repair is underway. Typically, relative large signs of orange and black are used to catch the attention of motorists and warn them of dangers or direct them to proper traffic lanes. Moving objects are known to attract attention much more readily than still objects; consequently, many sign stands are equipped with flags, usually of orange or yellow, or another bright color, to draw attention to the sign per se.

The prior art is replete with sign stands, bases, staffs, flags, flag holders, lights and light holders, etc. These are designed to draw the attention of passers by. Indeed, the sign stand art is crowded. Major advances that are also economically viable are few. The present invention lies in this crowded art.

Storing, displaying and recovering signs is an expensive and time-consuming part of a construction project. Loss of parts of signs is very common. Having a signing system that had an absolute minimum of moving parts would be desirable. Having a signing system that had no loose parts that could easily be lost would be desirable. Having a signing system that had no loose parts that could easily be misplaced would be desirable. Having a signing system that is easily displayed would be desirable. Having a signing system that easily recovered would be desirable. Having a signing system that folds to a minimal size for storage would be desirable. Having a signing system that, very importantly, includes flags as part of the system would be disirable. The present invention provides flags and flag mounting structure that accomplish the desired results as to the display of flags. The present invention also provides flags and flag mounting structure that can be used with many types and sizes of signs.

SUMMARY OF THE INVENTION

Flags and mounts are provided for use with flexible signs. Such signs are of the type typically made of plastic sheeting or fabric that are rolled for storage. The present invention permits the movement of captive mounted flags from a storage position adjacent a staff to a display position. In the display position the flags extend upwardly and outwardly from the sign and the staff.

The system may comprise a sign that cannot be rolled to which the flags are attached, directly or indirectly. Here the flags and the retainer for the flags lie within the area defined by the sign circumference and closely adjacent the back of the sign.

For purposes of the present disclosure, the best mode and most exemplary structure is described, however.

The invention comprises signing system. In a preferred embodiment the invention comprises a support staff, a flexible sign and a plurality of flags on separate flag poles. The proximate ends of the poles are pivotally secured to the staff. The respective flags are mounted on the respective poles adjacent the distal end of the poles. The invention comprises an elongate, resilient retaining member that can be folded, such as a bungee cord. The elongate, resilient retaining member is pivotally connected at the respective ends of said retaining member to the respective flag poles. The ends of the retaining member are connected to the poles intermediate the end of the respective poles. The retaining member is thus connected to permit the flags to be moved from a storage position to a display position. Means are provided to position the displayed flags in spaced relation one to another. The staff, flag poles, pivotal securing and pivotal connecting means and retaining member are so constructed as to permit the flag poles to move from a storage position adjacent the staff to a display position. This movement can be made only by stretching the retaining means. The staff, flag poles, pivotal securing and pivotal connecting means and retaining member are so constructed as to display the flags outwardly from the sign. Stated differently, the staff, flag poles, pivotal securing and pivotal connecting means and retaining members are so constructed as to permit the flag poles to pivot adjacent the proximal ends of the poles from a storage position wherein the poles are adjacent to the staff to a display position wherein the distal ends of the poles extend from the staff only by stretching the retaining means, and for retaining the flags in spaced display positions relative to each other.

The phrase "to permit the flag poles pivot adjacent the proximal ends thereof from a storage position wherein the poles are adjacent to the staff to a display position wherein the distal ends of the poles extend from the staff only by stretching the retaining means" is best understood by reading the words in proper order, starting with "to permit." The arrangement described permits the flag poles to move pivotally. The pivotal movement takes place adjacent, i.e. near or close to, the proximal ends of the flag poles. The flag poles move from a storage position. In the storage position the poles are adjacent, i.e., near or close to, the staff. The pivotal movement of the flag poles is to a display position. In the display position the distal ends of the poles extend from the staff. The pivotal movement can be accomplished only by stretching the retaining means; i.e., the pivotal movement described necessarily causes the retaining means to be stretched.

Thus, the flag poles can pivot from a storage position to a display position "only by stretching the retaining means." Stated differently, the flag poles cannot pivot from the storage position to the display position without stretching the retaining means.

To emphasize the structure in the most elementary terms to permit full understand: The flag poles pivot adjacent the proximal ends of the poles. The poles are adjacent the staff when they are in the storage position. When the poles are in the display position the poles extend from the staff.

The quoted phrase could be written "to permit the flag poles to pivot only by stretching the retaining means, the poles pivoting adjacently the proximal ends of the poles, from a storage position, in which storage position the poles are next to the staff, the pivoting moving the poles to a display position, in which display position the distal ends of the poles extend from the staff."

Special pivotal bushings are provided to permit retaining strap to fold in the storage position. As described, the retaining strap is an elongate resiliently stretchable retaining strap which can be folded.

The special pivotal bushings also permit the retaining strap to be rolled up inside a sign of the type that can be folded, if such a sign is used.

The special pivotal bushings also permit the retaining strap to be stored nearly flat with a solid sign if such a solid sign is used.

When the flags are in the display position, the flags are positioned apart from each other by a bumper bushing between the flag poles. The flag poles are retained adjacent the bumper by the resilient retainer strap.

The invention is preferably embodied in a signing system comprising a staff for supporting a flexible sign, a plurality of flag poles, flags mounted on the distal end of said poles, and means pivotally mounting the proximal ends of the flag poles to the staff. Means are provided on the staff or on any sign assembly that comprises or supports a sign, for positioning the flag poles. An elongate, resilient stretchable retainer means that can be folded is pivotally mounted at the respective ends of the retainer means. The respective ends of the retainer means are pivotally mounted to at least two of the flag poles. The retainer means retains the flag poles adjacent the positioning means when the poles are in a display position.

The retainer means also permits the flag poles to move only by stretching of the retainer means. The flag poles move only by stretching the retainer means to a storage position. In the storage position flag poles lie adjacent the staff. This arrangement gives an over-the-center mechanical effect. This over-the-center locking effect locks the flag poles either in the display position or in the storage position. The flag poles can be moved between the storage position and the display position only by the operator overcoming the stretch resistance of the resilient retainer during movement of the poles. In simple language, the retainer means permits the flag poles to pivot (adjacent the proximal ends of the poles) from a storage position (wherein the poles are adjacent to the staff) to a display position (wherein the distal ends of the poles extend from the staff) only by stretching the retaining means.

The signing system may also comprise a sign assembly that includes either a flexible or rigid sign. A plurality of flag poles having proximal and distal ends with flags mounted on the distal end of said poles are pivotally mounted at the proximal ends of said flag poles to any convenient portion of the sign assembly. More than two flag poles and flags may be used, if desired, without departing from the principles of operation and construction described herein. Means are secured to the sign assembly in a predetermined relation to the sign for positioning the flag poles. An elongate, resilient stretchable retainer means (that can be folded) is pivotally mounted at the respective ends of the retainer means to at least two of the flag poles. The retainer means so attached retains the flag poles adjacent the positioning means in a display position. During a transition from display position to storage position the retainer means so attached permits the flag poles to move only by stretching of the retainer means, such movement being to a storage position (wherein the flag poles lie adjacent the sign). Stated slightly differently but using the same terms, movement from a display position to storage position can be accomplished only by stretching the retainer means. Without stretching the retainer means, movement between the display position and the storage position is not possible. Thus, the operator cannot move the poles from the display position to the storage position without stretching the retaining means. Preferably, the retainer comprises a resilient cord that is capable of being folded and, in the storage position, lies adjacent the sign.

The signing system of the invention comprises, in combination: a staff; a first flag pole, said first flag pole having a proximal end and a distal end; a second flag pole, said second flag pole having a proximal end and a distal end; pole fastening means connecting the proximal end of the first flag pole and the proximal end of the second flag pole to the staff, said pole fastening means being constructed and configured to permit the first flag pole and the second flag pole to be pivotally moved on said pole fastening means between a storage position wherein the first flag pole and second flag pole are adjacent the staff, and a display position wherein the first flag pole and second flag pole extend from said staff, elongate resilient retainer means having a first end and a second end; first retainer fastening means connecting the first end of the retainer means to the first flag pole intermediate the proximal end of the first flag pole and the distal end of the first flag pole; and second retainer fastening means connecting the second end of the retainer means to the second flag pole intermediate the proximal end of the second flag pole and the distal end of the second flag pole; said retainer means being so constructed and connected that movement of said first flag pole and said second flag pole between said storage position and said display position stretches said retainer means.

DESCRIPTION OF THE PREFERRED EMBODIMENT

Figure 1:
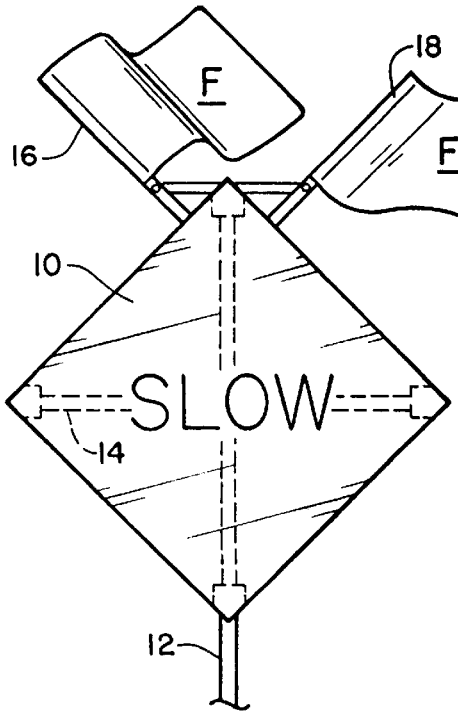
FIG. 1 depicts somewhat schematically a sign system utilizing the flag display system of this invention in a front elevational view, the lower portion of the staff being truncated.

The following description, which makes reference to the drawing, and the drawing depict a preferred embodiment of the invention and not the outer bounds of the scope of the invention. Many mechanical equivalents of various components, assemblies and subassemblies may be used without departing from the scope of the invention.

Reference is initially made to FIG. 1. The present invention is designed to be retrofitted to a conventional flexible sign 10 supported vertically by a staff 12 and laterally by a support beam 14, or to be built as part of new signs of this general type. There are a very large number and variety of flexible signs with which the present invention may be used to great advantage in savings of time and cost of materials. Such flexible signs and supporting staff structures and equivalent structures are well-known and widely used in the signing industry. This type of sign is typically made of fabric or plastic sheeting, e.g., polyvinyl chloride, polyethylene, etc., or fabric or fiber reinforced plastic. While, the greatest advantage results from the use of the invention in connection with flexible signs that are rolled for storage, it can be used with rigid signs or with sign staffs to which either rigid or flexible signs are attached. The poles 16 and 18 respectively support flags F extending upwardly and outwardly from the staff and sign to permit the flags to be moved by the wind of passing vehicles or atmospheric wind. The sign may have indicia, e.g., "SLOW," for warning motorists or others of danger, providing information or instruction to motorists, advertising the sale of goods or services, etc.

Figure 2:
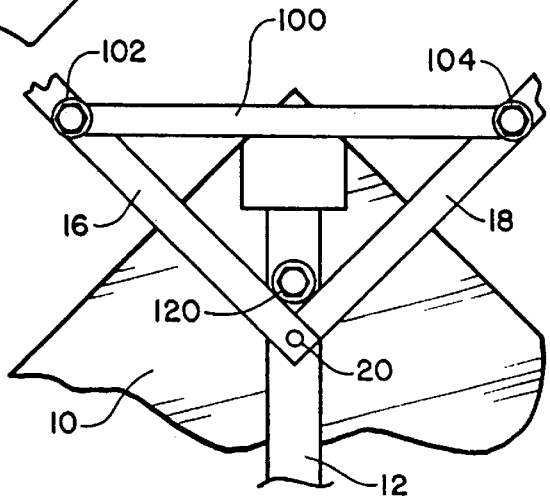
FIG. 2 depicts part of the back side of the sign and flag assembly shown in FIG. 1, with the flag poles in the upwardly extending display position, portions of the sign and the flags per se being omitted for clarity.

FIG. 2 depicts in generally schematic form, the flags being omitted for clarity of illustration, the poles and folding arrangement for the poles 16 and 18. In typical use, the poles may be metal or wood, regular or irregular in cross-section, or round or rectangular or of any other configuration in cross-section. Flat steel bars ⅛ to 3/16 inch thick and ½ to 1 inch wide and of any desired length may, for example, serve very well as poles. These are depicted in the drawing.

It will be noted that the poles 16 and 18 are pivotally connected by any suitable means 20 to the staff. If a rigid sign is used, the poles may be connected to the sign per se but most connections are made to the supporting staff.

A very important feature of the invention is the use of an elongate, resiliently stretchable, longitudinally foldable retaining member 100 pivotally connected at 102 and 104, respectively, to the respective poles 16 and 18. The poles, pivotally mounted at or near the proximate end thereof engage and rest against a bumper bushing assembly 120 that is also secured to the staff, or to other suitable structure, e.g., a rigid sign. The relationship of the poles, the pivot means 20, the bumper bushing assembly 120 and the retaining member 100 is such that in the extended or display position the flag poles are not permitted to extend in the same direction and, typically, as shown, are forced to extend upwardly from the staff and outwardly from each other and upwardly and outwardly from the sign. When the flags are in the display position, the retaining member 100 may be in a stretched or tensioned configuration but may be relatively free of tension so long as the flags cannot be moved to the storage position without stretching the retaining means. An important facet of the arrangement is that the retaining member 100 serves, in principle, as an over-the-center device, i.e., the retainer is placed under greater tension at an intermediate position between the display position and the storage position of the flag poles. This relationship will become more clear from the following discussion and reference to FIG. 3.

Figure 3:
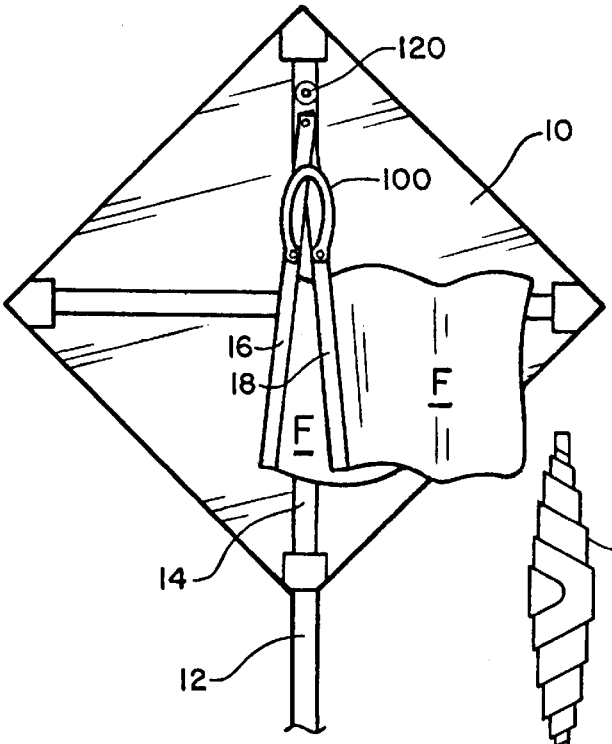
FIG. 3 depicts schematically the back side of a flag and sign assembly with the flags in the storage position ready to be rolled with the sign.
Figure 4:
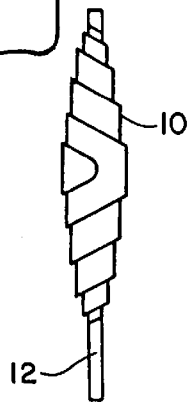
FIG. 4 depicts the rolled sign having the flags and flag support system rolled up inside the sign.

FIG. 3 depicts the signing device with the poles folded together and the device ready to be rolled to form a small, compact bundle such as is depicted in FIG. 4. Note that the retainer device 100 is loosely folded to be rolled up in the sign and the poles are parallel and adjacent to the staffs 12 and 14. From this position, it is necessary only to roll the sign 10 to achieve the storage configuration depicted in FIG. 4.

Consider now, the movement of the poles 16 and 18 pivotally about pivot point 20 from the display position depicted in FIG. 2 to the storage configuration depicted in FIG. 3. As the poles are moved downwardly, from the FIG. 3 position, the distance between pivotal connection points 102 and 104 increases. The components are so configured and constructed that the retainer device is placed under tension and stretched resiliently during this movement. Once the extreme lateral extension of the member is reached, the tension is released with continued movement and, ultimately, the retaining member folds one or more times so that it can be rolled conveniently into the sign along with the poles and flags.

Figure 5:
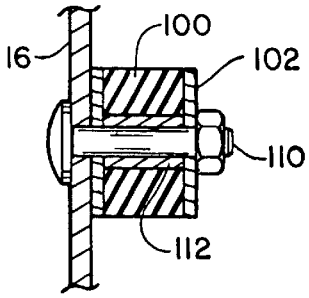
FIG. 5 is a greatly enlarged depiction, in partial cross-section, of an important feature of the invention, namely the pivotal mounting means for the ends of a resilient, bendable elongate device that folds for storage and locks the flags in position for display.

Reference is made now to FIG. 5 that depicts in partial cross-section the pivotal connector 102 for the retaining means 100 to the pole 16. The connector 104 is of the same construction. An end of the retaining means, which in a preferred embodiment is a rubber stretch chord sometimes called a "bungee" cord, is connected to the pole by structure that permits the retainer chord to pivot without touching threads or other structure that would fray, wear or cut the chord material. In the preferred embodiment, the retaining means is a solid rubber strap from about one foot to two feet in length, when not stretched, and resiliently stretchable without permanent deformation or breakage to about one and one/half times its non stretched length. These dimensions and values are, of course, not critical and vary depending on the length of the flag poles and size of the sign. Straps of the type described are available in all hardware and truck supply stores and are used by the millions in tying down loads, tying down coverings, keeping coverings taut, etc. Other elongate foldable resilient devices such as the more conventional woven or twisted rubber band "bungee" cords, and even metal springs may be used. In the case of traditional multiple strand bungee cords, the cord would form a loop at the end which, of course, is equivalent to the passage in the solid rubber stretch cord depicted in the drawing. For descriptive purposes and as the preferred embodiment, reference is made to the solid rubber stretch cord as exemplary. The end of the retainer strap 100 has an aperture there through (or is attached to a device having an aperture) through which a bushing 112 extends, the strap and bushing being connected to and the pole 16 by any suitable fastener such as, for example, the bolt, nut and washer assembly 110 as depicted in FIG. 5. It is very important that the ends of the strap are pivotally connected to the poles. A fixed connection or another type of connection that would not permit the strap to fold, as shown in FIG. 3, for being rolled, etc., would not achieve the best results. Other types of connections, fittings, fasteners, etc., may, of course be used if the result is that the retaining device can fold when in the storage position and stretch as it is moved to the display position. It may, or may not, be in a state of tension in the display position. It is preferred that the retainer strap be in a condition of slight tension in the display position but this is not necessary.

Figure 6:
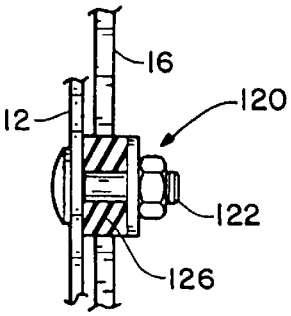
FIG. 6 is a greatly enlarged depiction, in partial cross-section, of another important feature of the invention, namely a bumper bushing for fixing the display position of the flag poles.

It is also important to provide a bumper against which the poles rest, when the poles are in the display position, to prevent the poles from coming together, tangling the flags, etc., and generally reducing the visibility of the flags when the device is in use. Such a structure is depicted in FIG. 6 to which reference is now made. The bumper assembly 120 comprises a bolt, nut and washer combination type fastener, or other suitable fastener, for securing the resilient buffer bushing 126 to the staff 12. A neoprene rubber, or other resilient material that will resist wear and not damage the poles is suitable.

Thus, it will be seen that the signing system of the invention comprises, in combination: a staff 12; a first flag pole 16, said first flag pole having a proximal end, shown at the bottom in FIG. 2, and a distal end; a second flag pole 18, said second flag pole having a proximal end, shown at the bottom in FIG. 2, and a distal end; pole fastening means 20 connecting the proximal end of the first flag pole and the proximal end of the second flag pole to the staff, said pole fastening means being constructed and configured to permit the first flag pole and the second flag pole to be pivotally moved on said pole fastening means between a storage position shown in FIG. 3, wherein the first flag pole and second flag pole are adjacent the staff, and a display position, shown in FIG. 1, wherein the first flag pole and second flag pole extend from said staff; elongate resilient retainer means 100 having a first end, on the left in FIG. 2, and a second end, on the right in FIG. 2; first retainer fastening means 102 connecting the first end of the retainer means to the first flag pole intermediate the proximal end of the first flag pole and the distal end of the first flag pole; and second retainer fastening means 104 connecting the second end of the retainer means to the second flag pole intermediate the proximal end of the second flag pole and the distal end of the second flag pole; said retainer means being so constructed and connected that movement of said first flag pole and said second flag pole between said storage position and said display position stretches said retainer means.

Those skilled in the art will realize immediately that as to particular elements, assemblies, fastening devices, etc., there is no criticality and many types of structures and devices may be used. It is the unique working arrangement and relationship that accomplish the long sought goal of an economical captive flag display system.

Industrial Application

This invention finds use in the signing industry generally, in highway and street construction and repair, and in advertising and business display industries.

What is claimed is:

1. In a signing system that comprises a support staff, a flexible sign and a plurality of flags, the improvement wherein the system comprises, in combination:

a plurality of flag poles, each of which has a distal end and a proximal end;

means pivotally securing the proximal end of the flag poles to the staff with the distal end extended;

the respective flags being mounted adjacent to the distal end of the respective poles;

an elongate, resilient, foldable retaining member having ends;

means pivotally connecting the respective ends of the retaining member to the respective flag poles intermediate the ends of said respective flag poles; and means on the staff for positioning the flags, when in a display position, extending outwardly from the sign;

the staff, flag poles, pivotal securing and pivotal connecting means and retaining member being so constructed as to permit the respective flag poles to be moved by pivoting adjacent said proximal ends of said poles from a storage position, wherein the poles are adjacent to the staff, to a display position, wherein the distal ends of the poles extend from the staff, said pivoting movement stretching the retaining means, and for retaining the flags in spaced relationship to each other when the in the display position.

2. The signing system of claim 1 wherein the means pivotally connecting the retaining member to the flag poles comprises a bushing pivotally mounted on a fastener.

3. The signing system of claim 2 wherein the means for positioning the flags, when in the display position, comprises a resilient bumper bushing against which the flag poles rest.

4. The signing system of claim 1 wherein the means for positioning the flags, when in the display position, comprises a resilient bumper bushing against which the flag poles rest.

5. A signing system comprising a staff for supporting a sign, a plurality of flag poles having proximal and distal ends, flags mounted on the respective distal ends of said poles, means pivotally mounting, the proximal ends of the flag poles to the staff for pivotal movement between a display position and a storage position, means on the staff for positioning the flag poles, and elongate, resilient, foldable, stretchable retainer means having ends pivotally mounted at the respective ends of said retainer means to at least two of the flag poles for retaining the flag poles adjacent the positioning means in the display position and for permitting the flag poles to be moved to the storage position only by stretching of the retainer means.

6. The signing system of claim 5 wherein the retainer comprises a resilient cord.

7. A signing system comprising a sign assembly, a plurality of flag poles having proximal and distal ends, flags mounted on the distal end of said poles, a sign staff, means pivotally mounting the proximal ends of the flag poles to said sign staff to permit pivotal movement between a storage position, wherein the flag poles lie adjacent the sign staff, and a display position, means for positioning the flag poles in the display position to extend from the flag pole, and elongate, resilient stretchable retainer means pivotally mounted at the respective ends of said retainer means to at least two of the flag poles, said retaining means being constructed and connected to retain the flag poles adjacent the positioning means in a display position and to permit the flag poles to move between the display position and the storage position only by stretching of the retainer means.

8. The signing system of claim 7 wherein the retaining means comprises a resilient cord that is foldable and lies adjacent the sign when the poles are in the storage position.

9. A signing system comprising, in combination:

a staff;

a first flag pole, said first flag pole having a proximal end and a distal end;

a second flag pole, said second flag pole having a proximal end and a distal end;

pole fastening means connecting the proximal end of the first flag pole and the proximal end of the second flag pole to the staff, said pole fastening means being constructed and configured to permit the first flag pole and the second flag pole to be pivotally moved on said pole fastening means between a storage position, wherein the first flag pole and second flag pole are adjacent the staff, and a display position, wherein the first flag pole and second flag pole extend from said staff;

elongate resilient retainer means having a first end and a second end for retaining said flag poles in the display position;

first retainer fastening means connecting the first end of the retainer means to the first flag pole intermediate the proximal end of the first flag pole and the distal end of the first flag pole; and second retainer fastening means connecting the second end of the retainer means to the second flag pole intermediate the proximal end of the second flag pole and the distal end of the second flag pole;

said retainer means being so constructed and connected that movement of said first flag pole and said second flag pole between said storage position and said display position stretches said retainer means.

* * * * *